US009634419B2

(12) United States Patent
Zhou et al.

(10) Patent No.: US 9,634,419 B2
(45) Date of Patent: Apr. 25, 2017

(54) COLD FORMING METHOD FOR FORMING POWER PINS AND POWER PIN FORMED THEREOF

(71) Applicants: Manzhi Zhou, Hunan (CN); Guangdong Song, Jiangsu (CN)

(72) Inventors: Manzhi Zhou, Hunan (CN); Guangdong Song, Jiangsu (CN)

( * ) Notice: Subject to any disclaimer, the term of this patent is extended or adjusted under 35 U.S.C. 154(b) by 0 days.

(21) Appl. No.: 14/809,289

(22) Filed: Jul. 27, 2015

(65) Prior Publication Data

US 2016/0336675 A1 Nov. 17, 2016

(30) Foreign Application Priority Data

May 17, 2015 (CN) ..... 2015 1 0248457
May 17, 2015 (CN) ..... 2015 2 0314825 U

(51) Int. Cl.

| | |
|---|---|
| ***H01R 43/00*** | (2006.01) |
| ***H01R 13/405*** | (2006.01) |
| ***H01R 43/16*** | (2006.01) |
| ***H01R 43/02*** | (2006.01) |
| ***B21K 21/08*** | (2006.01) |
| ***B21J 9/02*** | (2006.01) |

(52) U.S. Cl.
CPC ..... *H01R 13/405* (2013.01); *B21J 9/022* (2013.01); *B21K 21/08* (2013.01); *H01R 43/02* (2013.01); *H01R 43/16* (2013.01)

(58) Field of Classification Search
CPC ..... H01R 13/405; H01R 43/16
USPC ..... 29/874, 876, 877, 884
See application file for complete search history.

(56) References Cited

U.S. PATENT DOCUMENTS

| | | | | |
|---|---|---|---|---|
| 3,058,091 | A * | 10/1962 | Henschen | H01R 13/111 29/874 |
| 5,641,311 | A * | 6/1997 | Chuang | H01R 13/44 439/693 |
| 5,688,150 | A * | 11/1997 | Seidler | H01R 12/57 439/876 |
| 8,021,183 | B2 * | 9/2011 | Early | H01R 13/665 439/382 |
| 8,215,009 | B2 * | 7/2012 | Early | H01R 13/665 29/838 |
| 8,480,410 | B2 * | 7/2013 | Early | H01R 13/665 439/620.21 |
| 2007/0054565 | A1 * | 3/2007 | Courtin | H01R 43/0488 439/851 |
| 2007/0294873 | A1 * | 12/2007 | Bogursky | H01R 4/188 174/84 C |

(Continued)

*Primary Examiner* — Peter DungBa Vo
*Assistant Examiner* — Kaying Kue

(57) ABSTRACT

The invention discloses a cold forming method for forming power pins and a power pin formed thereof. The cold forming method for forming power pins comprises the following steps: step 1: cutting blank out; step 2: pre-forming the power pin body by necking; step 3: trimming the pre-formed power pin body, and pre-forming a pin fixing disk; step 4: forming the pin fixing disk and a staggered weld leg of pin. The invention also discloses a power pin formed by the cold forming method, composed of a power pin body, a pin fixing disk and a staggered weld leg of pin which are integrally formed into one piece by the cold forming method. The invention achieves high-speed automatic production and high production efficiency with a simple process, and improves material utilization and strength.

12 Claims, 3 Drawing Sheets

(56) References Cited

U.S. PATENT DOCUMENTS

| | | | | |
|---|---|---|---|---|
| 2009/0209137 | A1* | 8/2009 | Hsu | H01R 13/04 439/668 |
| 2010/0112848 | A1* | 5/2010 | Early | H01R 13/665 439/441 |
| 2010/0320067 | A1* | 12/2010 | Blomeyer | A61B 18/1402 200/5 A |

* cited by examiner

COLD FORMING METHOD FOR FORMING POWER PINS AND POWER PIN FORMED THEREOF

CROSS-REFERENCE TO RELATED APPLICATIONS

This present application claims the benefits of Chinese Patent Application No. 201510248457.9 filed on May 17, 2015 and Chinese Utility Model Application No. 201520314825.0 filed on May 17, 2015, the contents of which are hereby incorporated by reference.

FIELD OF THE INVENTION

The invention relates to a cold forming method, in particular to a cold forming method for forming power pins.

DESCRIPTION OF THE RELATED ART

With improvement of living standards in the society, communication equipment, electronic equipment, household appliances, automobiles, etc. (e.g. smart phones, televisions, refrigerators, electric tools) have become the most common products enriching people's life, therefore the plugs for connecting them to power supplies are widely applied. In the prior art, the pin for power plug is of ordinary sectional materials, and is machined with ordinary punching machine, machining tool, machining center, etc. The machining process has such disadvantages as complicated process, low production efficiency and low material utilization, which results in high material cost, high machining cost, low strength, etc.

SUMMARY OF THE INVENTION

A technical problem to be solved by the invention is to provide a cold forming method for forming power pins. The method can achieve high-speed automatic production and high production efficiency with a simple process, and improve material utilization and strength.

In order to solve the technical problems, the technical solution of the invention is as follows: 1. A cold forming method for forming power pins, comprising the following steps:

step 1: cutting blank out;

step 2: pre-forming the power pin body by necking;

step 3: trimming the pre-formed power pin body, and pre-forming a pin fixing disk; and step 4: forming the pin fixing disk and a staggered weld leg of pin.

Preferably, in step 1, an intermittent automatic stepping blanking system is used to automatically cut blank with a proper length from a wire material with a diameter close to that of the circumcircle of the pin power body or a wire material with a proper intensification ratio, and synchronously convey the blank to a cold extrusion station in a multi-stroke cold forming machine through an automatic feeding system.

Preferably, in step 2, the blank cut out is pushed into a first main mould for extrusion through a die at the first stroke, so as to pre-form the power pin body by necking; successively form the sections I, II, III of the power pin; and eject the pre-formed blank out through an ejector of the first main mould.

Preferably, a die-entrance angle less than 1° is arranged in a forming die cavity of the first main mould, so that every side of the section I of the power pin formed by extrusion has a die-entrance angle less than 1° by intensified forming.

Preferably, in step 3, the blank pre-formed in step 2 is pushed by the automatic feeding system into a second main mould through a die at the second stroke; the dimension precision and structure of the power pin body are trimmed, and the pin fixing disk is pre-formed; the step of trimming the dimension precision and structure of the power pin body comprises: trimming the die-entrance angle less than 1° by intensified forming of the section I of the power pin, and successively extruding the sections I, II, III of the power pin to form the sections I', II', III' of the power pin; as the diameter of the section III' of the power pin is larger than that of the section III of the power pin, the section III' of the power pin is the pre-formed pin fixing disk.

Preferably, in step 4, the blank obtained in step 3 is pushed by the automatic feeding system into a third main mould for extrusion through a die at the third stroke; the third main mould and the third die are arranged on different axes; the section III' of the power pin is extruded to form the staggered weld leg of pin and a pin fixing disk which is formed in the relative extrusion gap between the third die and the third main mould; thus the power pin body, the pin fixing disk and the staggered weld leg of pin are all formed.

Preferably, a die-entrance angle less than 1° is arranged in a forming die cavity of the third die, so that every side of the staggered weld leg of pin formed by extrusion has a die-entrance angle less than 1° by intensified forming. An arc with a radius less than 0.5 mm is arranged at the opening of the third die. Setting the arc at the opening of the third die can disperse the stress concentrating during clod extrusion, increase the strength of the integral structure of the workpiece, and avoid workpiece breakage due to excessive stress concentration.

Preferably, the staggered weld leg of pin is not located on the same axis with the power pin body and the pin fixing disk, and the eccentric distance and position angle of the staggered weld leg of pin can be adjusted based on the product design requirements.

Preferably, the cold forming method for forming power pins further comprises a step 5: shaping the pin fixing disk, trimming the pin fixing disk based on the installation space of the power pin required for design; pushing the blank formed in step 4 into a fourth main mould with a shape matching that of the power pin body through the automatic feeding system, so that the blank is supported and fixed by the end surface of the fourth main mould; and trimming the pin fixing disk through the fourth die, thus forming various pin fixing disks as required.

The invention also discloses a power pin formed by the cold forming method, composed of a power pin body formed by the cold forming method, a pin fixing disk formed by the cold forming method and a staggered weld leg of pin formed by the cold forming method, and the power pin body, the pin fixing disk and the staggered weld leg of pin are integrally formed into one piece, and the staggered weld leg of pin and the power pin body are respectively arranged at both ends of the pin fixing disk and are located on different axes.

Preferably, the power pin body is rectangle- or cylinder-shaped.

Preferably, the pin fixing disk is circle- or hexagon- or rectangle- or oval-shaped.

Preferably, the staggered weld leg of pin is rectangle- or cylinder-shaped.

The positive progressive effects of the invention are as follows: 1. The invention is of high-speed full-automatic continuous machining, cancels the traditional machining, punching by a punch and other complicated machining process, has high production efficiency (i.e. more than 65 workpieces per minute), and is suitable for mass production; 2. The invention has high material utilization (more than 95%), which reduces material cost; 3. The power pin manufactured with the method of the invention has a strength higher than that of the existing power pins, as the power pin is formed by the cold forming method and does not involve welding, etc.; 4. The invention can make the staggered weld leg of pin and the power pin body formed at both ends of the pin fixing disk and located on different axes, thus forming a staggering condition, and the invention can adjust the eccentric distance, relative position angle, etc. of the axes according to the assembly space, which is convenient to fix the staggered weld leg of pin and other elements and can meet different design requirements; 5. The invention uses a multi-stroke cold forming machine to automatically cut blank out in a linkage manner, and convey the blank formed at each station to the next station synchronously; the blank is quickly extruded by the die at each station synchronously; while the die returns back to its original place, the ejector of the ejector system ejects out in each main mould; the blank formed at each station is synchronously conveyed by the automatic feeding system to the die opening at the next station to form in a production cycle, which further improves the production efficiency.

DESCRIPTION OF THE PREFERRED EMBODIMENT

The following preferred embodiments of the invention are given in combination with drawings so as to describe the technical solution of the invention in detail.

Figure 1:
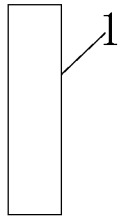
FIG. 1 is a structural diagram of a power pin product after being machined in step 1.

A cold forming method for forming power pins in the invention comprises the following steps:

Step 1: cutting blank out (FIG. 1): an intermittent automatic stepping blanking system is used to automatically cut blank 1 with a proper length from a wire material with a diameter close to that of the circumcircle of the pin power body or a wire material with a proper intensification ratio, and synchronously convey the blank to a cold extrusion station in a multi-stroke cold forming machine through an automatic feeding system, wherein the blank 1 may be cylinder-shaped and is automatically cut out from the wire material for cold forming.

Figure 2:
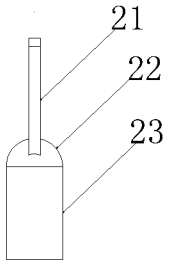
FIG. 2 is a planar structural diagram of the power pin product after being machined in step 2.
Figure 3:
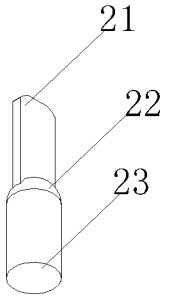
FIG. 3 is a three-dimensional structural diagram of the power pin product after being machined in step 2.

Step 2: forming a power pin body by necking (FIG. 2 and FIG. 3), which is the first work step of the cold extrusion process by the multi-stroke cold forming machine: pushing the blank 1 cut out into a first main mould for extrusion through a die at the first stroke, so as to pre-form the power pin body by necking; successively forming the sections I, II, III of the power pin (21, 22, 23); and ejecting the pre-formed blank out through an ejector of the first main mould. Wherein the first work step is actually a deformation step by necking and intensified forming, and used for preliminarily pre-forming the power pin body. Step 2 is characterized in that: A1. The section I of the power pin 21 has a die-entrance angle less than 1° and is hemispherical at the joint with the section II of the power pin 22. Furthermore, the section I of the power pin 21 has a special necking opening with a smooth transition fillet having a radius of about 0.5 mm. Upon extrusion, the metal material is cold hardened, and then have good rigidity, strength and elasticity, thus decreasing the risk of breakage due to stress bearing or bending; A2. The section I of the power pin 21 may be rectangle—or cylinder-shaped, etc.; A3. The structure of the section II of the power pin 22 is a hemispheric transition necking belt, which makes the metal material flow in the die cavity sufficiently during extrusion, and keeps the product with good metal flow lines; A4. The section III of the power pin 23 is the remaining blank, deformed by extrusion, for forming the pin fixing disk and staggered weld leg of pin in the subsequent process.

Figure 4:
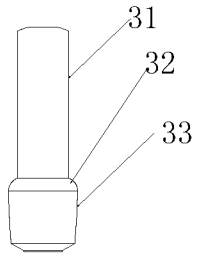
FIG. 4 is a planar structural diagram of the power pin product after being machined in step 3.
Figure 5:
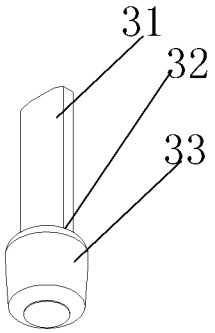
FIG. 5 is a three-dimensional structural diagram of the power pin product after being machined in step 3.

Step 3: trimming the pre-formed power pin body, and pre-forming a pin fixing disk (FIG. 4 and FIG. 5), which is the second work step of cold extrusion process by the multi-stroke cold forming machine: using the automatic feeding system to push the blank pre-formed in step 2 into a second main mould through a die at the second stroke. The step of trimming the dimension precision and structure of the power pin body comprises: trimming the die-entrance angle less than 1° by intensified forming in the first work step of the section I of the power pin; and successively extruding the sections I, II, III of the power pin (21, 22, 23) to form the sections I', II', III' of the power pin (31, 32, 33). The diameter of the section III' of the power pin (33) is larger than that of the section III of the power pin (23). Step 3 is characterized in that: B1. Forming the section I' of the power pin 31 by extrusion according to the dimension and shape of the cavity of the second main mould, and trimming the die-entrance angle less than 1° by intensified forming in the first work step of the section I of the power pin; B2. Forming the section III' of the power pin 33 through the die at the second stroke, which is mainly for pre-upsetting for forming in work step 3 (step 4). The pre-upsetting process aims at forming the upsetting ratio that can be formed in work step 3 and retaining good metal flow line transition for the forming in the subsequent work steps; B3. The shape and height of the section III' of the power pin 33 are key factors directly influencing the height and dimension of the staggered weld leg of pin to be formed in the next work step.

Figure 6:
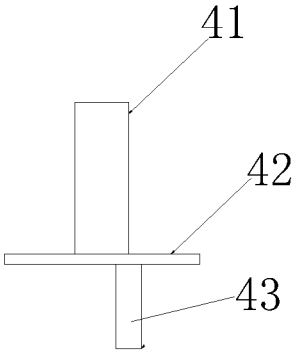
FIG. 6 is a planar structural diagram of the power pin product after being machined in step 4.
Figure 7:
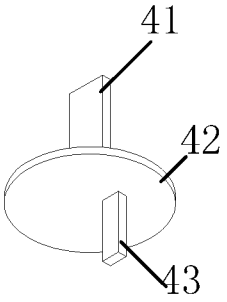
FIG. 7 is a three-dimensional structural diagram of the power pin product after being machined in step 4.

Step 4: forming the integral power pin (FIG. 6 and FIG. 7), which is the third work step of cold extrusion process by the multi-stroke cold forming machine: using the automatic feeding system to push the blank obtained in step 3 into a third main mould for extrusion through a die at the third stroke; extruding the section III' of the power pin 33 pre-formed in step 3 to form the staggered weld leg of pin 43; forming the pin fixing disk 42 in the relative extrusion gap between the third die and the third main mould, thus the power pin body 41, the pin fixing disk 42 and the staggered weld leg of pin 43 are all formed so as to meet the dimension requirements of drawing design. Step 4 is characterized in that: C1. The shape and structure of the internal cavity of the third main mould at the third stroke and the staggered weld leg of pin 43 is consistent with the designed shape and structure, and the metal material flows after being extruded by the third die, thus forming the staggered weld leg of pin 43 so as to meet the requirements for design precision; C2. The die for forming the staggered weld leg of pin has a penetrating die cavity matching the staggered weld leg of pin, thus forming an exhaust hole; C3. A die-entrance angle less than 1° is arranged in a forming die cavity of the third die, and an arc with a radius less than 0.5 mm is arranged at the opening of the third die. Setting of the arc makes both the power pin body 41 and the staggered weld leg of pin 43 present smooth transition fillet (radius: <0.5 mm) with the pin fixing disk connected, which can disperse the stress concentrating during clod extrusion, increase the strength of the integral workpiece, and avoid workpiece breakage due to excessive stress concentration; C4. The staggered weld leg of pin 43 is not located on the same axis with the power pin body 41 and the pin fixing disk 42, and the eccentric distance, position angles, etc. of the staggered weld leg of pin 43 with the power pin body 41 and the pin fixing disk 42 can be adjusted based on the product design requirements; C5. The staggered weld leg of pin 43 can be rectangle—or cylinder-shaped, etc., and its height can be adjusted based on the assembly requirements. The pin fixing disk 42 can be circle-, oval-, hexagon- or rectangle-shaped, etc.

Figure 8:
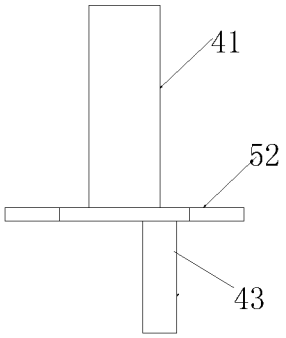
FIG. 8 is a planar structural diagram of the power pin product after being machined in step 5.
Figure 9:
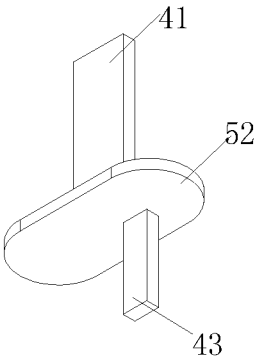
FIG. 9 is a three-dimensional structural diagram of the power pin product after being machined in step 5.

Step 5 (optional): shaping the pin fixing disk, trimming the pin fixing disk to the shape (FIG. 8 and FIG. 9) based on the installation space designed by a customer (e.g. rectangle, hexagon or oval shown in FIG. 8 and FIG. 9), which is the fourth work step of cold extrusion process by the multi-stroke cold forming machine: pushing the blank formed in step 4 into a fourth main mould with a shape matching that of the power pin body through the automatic feeding system, so that the blank is supported and fixed by the end surface of the fourth main mould; and trimming the circular pin fixing disk through the fourth die, thus forming various shapes of pin fixing disks required for blocking out or rotation prevention by injection bearing certain push-pull effort. Step 5 is characterized in that: D1. The end surface of the fourth main mould presents a planar boss identical with the trimmed pin fixing disk 52 in shape, which is convenient for coordinating with the fourth die to trim; D2. The internal cavity of the fourth die is in an inverted-cone shape, which is identical with that of the trimmed pin fixing disk 52. The dimension of the opening of the fourth die is consistent with the trimmed pin fixing disk 52, and has a proper closing clearance with the fourth main mould.

All steps in the invention are synchronously finished in an intermittent linkage feeding manner, thus producing a power plug pin formed by the cold forming method with a high-speed multi-stroke cold forming machine of the invention in a full-automatic manner.

With the basic structure based on the existing social common standard as the concept, the invention makes full use of the cold extrusion characteristics of the multi-stroke cold forming machine, and designs the disk produced in the die gap between the upper and lower dies of the multi-stroke cold forming machine into a pin fixing disk. In addition, the pin fixing disk is mainly formed by extruding at the die gap between the power pin body and the staggered weld leg of pin at both ends by using the cold forming and extrusion process.

Based on the insufficiencies of the traditional machining method, the invention makes full use of the characteristics of the cold forming and extrusion technologies, and achieves high-speed automatic production for a common power pin in the society. The power pin is characterized in that: the power pin body, the pin fixing disk and the staggered weld leg of pin may be not located on the same axis, and the structure and position (e.g. eccentric distance, relative angle, shape) of the pin can be adjusted flexibly according to the space utilization set by the designer, which is the first achievement in the field of the existing cold forming and extrusion technologies.

The invention is characterized by a simple process and high production efficiency; increases material utilization and strength; achieves high-speed automatic production; and is suitable for standardized mass production. In addition, the invention can be widely applied in the plugs of communication equipment, electronic equipment, household appliance, automobile, etc. The invention completely solves the insufficiencies of the traditional machining process, and reduces production cost.

The above embodiments further describe the technical problems to be solved by the invention, the technical solution and beneficial effects in detail. It should be understood that the above are only embodiments of the invention and are not used to limit the invention. Any modifications, equivalent replacements and improvements made within the range of the spirit and rule of the invention will fall within the protection range of the invention.

What is claimed is:

1. A cold forming method for forming power pins, comprising the following steps:

step 1: cutting a blank out;

step 2: pre-forming a power pin body by necking;

step 3: trimming the pre-formed power pin body, and pre-forming a pin fixing disk; and step 4: forming the pin fixing disk and a staggered weld leg of the pin;

wherein in the step 1, an intermittent automatic stepping blanking system is used to automatically cut the blank out with a proper length from a wire material with a diameter close to that of the circumcircle of the power pin body or a wire material with a proper intensification ratio, and synchronously convey the blank to a cold extrusion station in a multi-stroke cold forming machine through an automatic feeding system; and wherein in the step 2, the cut out blank is pushed into a first main mould for extrusion through a first die at a first stroke, so as to pre-form the power pin body by necking; successively form first, second, and third sections of the power pin; and eject the pre-formed blank through an ejector of the first main mould.

2. The cold forming method for forming power pins according to claim 1, wherein further comprising a step 5: trimming the pin fixing disk; trimming the pin fixing disk based on installation space of the power pin required for design; pushing the blank formed in step 4 into a fourth main mould with a shape matching that of the power pin body through the automatic feeding system, so that the blank is supported and fixed by an end surface of the fourth main mould; and trimming the pin fixing disk through a fourth die, thus forming various pin fixing disks required.

3. The cold forming method for forming power pins according to claim 1, wherein a die-entrance angle less than 1° is arranged in a forming die cavity of the first main mould, so that every side of the first section of the power pin formed by extrusion has a die-entrance angle less than 1° by intensified forming.

4. The cold forming method for forming power pins according to claim 3, wherein further comprising a step 5: trimming the pin fixing disk; trimming the pin fixing disk based on installation space of the power pin required for design; pushing the blank formed in step 4 into a fourth main mould with a shape matching that of the power pin body through the automatic feeding system, so that the blank is supported and fixed by an end surface of the fourth main mould; and trimming the pin fixing disk through a fourth die, thus forming various pin fixing disks required.

5. The cold forming method for forming power pins according to claim 3, wherein, in the step 3, the blank formed in the step 2 is pushed by the automatic feeding system into a second main mould through a second die at the second stroke; the dimension precision and structure of the power pin body are trimmed, and the pin fixing disk is pre-formed; the step of trimming the dimension precision and structure of the power pin body comprises: trimming the die-entrance angle less than 1° by intensified forming of the first section of the power pin, and successively extruding the first, second, and third sections of the power pin to form extruded first, second, and third sections of the power pin; as the diameter of the extruded third section of the power pin is larger than that of the third section of the power pin, the extruded third section of the power pin is the pre-formed pin fixing disk.

6. The cold forming method for forming power pins according to claim 5, wherein further comprising a step 5: trimming the pin fixing disk; trimming the pin fixing disk based on installation space of the power pin required for design; pushing the blank formed in step 4 into a fourth main mould with a shape matching that of the power pin body through the automatic feeding system, so that the blank is supported and fixed by an end surface of the fourth main mould; and trimming the pin fixing disk through a fourth die, thus forming various pin fixing disks required.

7. The cold forming method for forming power pins according to claim 5, wherein in the step 4, the blank obtained in step 3 is pushed by the automatic feeding system into a third main mould for extrusion through a third die at the third stroke; the third main mould and the third die are arranged on different axes; the extruded third section of the power pin is extruded to form the staggered weld leg of the pin and the pin fixing disk which is formed in the relative extrusion gap between the third die and the third main mould; thus the power pin body, pin fixing disk and staggered weld leg of the pin are all formed.

8. The cold forming method for forming power pins according to claim 7, wherein further comprising a step 5: trimming the pin fixing disk; trimming the pin fixing disk based on installation space of the power pin required for design; pushing the blank formed in step 4 into a fourth main mould with a shape matching that of the power pin body through the automatic feeding system, so that the blank is supported and fixed by an end surface of the fourth main mould; and trimming the pin fixing disk through a fourth die, thus forming various pin fixing disks required.

9. The cold forming method for forming power pins according to claim 7, wherein a die-entrance angle less than 1° is arranged in a forming die cavity of the third die, so that every side of the staggered weld leg of the pin formed by extrusion has a die-entrance angle less than 1° by intensified forming; in addition, an arc with radius less than 0.5 mm is arranged at an opening of the third die.

10. The cold forming method for forming power pins according to claim 9, wherein further comprising a step 5: trimming the pin fixing disk; trimming the pin fixing disk based on installation space of the power pin required for design; pushing the blank formed in step 4 into a fourth main mould with a shape matching that of the power pin body through the automatic feeding system, so that the blank is supported and fixed by an end surface of the fourth main mould; and trimming the pin fixing disk through a fourth die, thus forming various pin fixing disks required.

11. The cold forming method for forming power pins according to claim 7, wherein the staggered weld leg of the pin is not located on the same axis with the power pin body and the pin fixing disk, and eccentric distance and position angle can be adjusted based on product design requirements.

12. The cold forming method for forming power pins according to claim 11, wherein further comprising a step 5: trimming the pin fixing disk; trimming the pin fixing disk based on installation space of the power pin required for design; pushing the blank formed in step 4 into a fourth main mould with a shape matching that of the power pin body through the automatic feeding system, so that the blank is supported and fixed by an end surface of the fourth main mould; and trimming the pin fixing disk through a fourth die, thus forming various pin fixing disks required.

* * * * *